United States Patent [19]

Bokelund et al.

[11] Patent Number: 4,813,196

[45] Date of Patent: Mar. 21, 1989

[54] STRUCTURAL SYSTEM

[75] Inventors: Carl G. Bokelund, Hillsborough; Michael P. Cronan, Oakland; Clyde J. Winters, San Francisco, all of Calif.

[73] Assignee: Greyhound Exhibitgroup Inc., Elk Grove Village, Ill.

[21] Appl. No.: 867,248

[22] Filed: May 22, 1986

[51] Int. Cl.[4] ..... E04C 2/34

[52] U.S. Cl. ..... 52/775; 52/738

[58] Field of Search ..... 52/243, 281, 775

[56] References Cited

U.S. PATENT DOCUMENTS

| | | | |
|---|---|---|---|
| 3,416,275 | 12/1968 | Van Loghem et al. | 52/775 X |
| 3,429,090 | 2/1969 | Metelnick | 52/775 X |
| 3,943,680 | 3/1976 | Balinski | 52/738 X |
| 4,530,194 | 7/1985 | Linton et al. | 52/281 X |

FOREIGN PATENT DOCUMENTS

| | | | |
|---|---|---|---|
| 1045905 | 12/1953 | France | 52/243 |
| 2032354 | 10/1979 | United Kingdom | 52/243 |

*Primary Examiner*—David A. Scherbel
*Assistant Examiner*—Creighton Smith
*Attorney, Agent, or Firm*—Bernard L. Howard

[57] ABSTRACT

A structural system that is particularly useful for temporary exhibitions and trade shows by which structures may be quickly and easily assembled, rearranged, and disassembled by simple procedures requiring few or no tools, using a minimum number of components having a high degree of interchangeability. Posts are provided each having a series of preformed holes arranged along its sides with predetermined spacing, and panels are provided each having pairs of alignment pins symmetrically arranged on both faces and adjacent both ends and also having an intermediate hole adjacent both ends thereof, whose longitudinal axes are perpendicular to the faces of each panel. A panel is aligned with a post by inserting the alignment pins adjacent an end of said panel into corresponding holes in the post, and the panel is secured to the post by inserting a fastener through the hole in the panel and into locking engagement with a corresponding hole in the post. Angle brackets each having two faces disposed at predetermined angles to each other are also provided by which panels may be mounted at predetermined angles to posts. One face of each such angle bracket comprises a panel mount adapted to be secured to panels, and another face of the angle bracket comprises a post mount adapted to be secured to posts, each mount using the alignment pin and connection means of the invention. The panels serve both a structural and decorative function, and the structural system provides significant flexibility in the arrangement of structures which can be made from these components.

20 Claims, 4 Drawing Sheets

STRUCTURAL SYSTEM

BACKGROUND OF THE INVENTION

This invention relates to structural systems in general, and to temporary structural systems used in exhibitions and trade shows in particular, and to means for facilitating the assembly, rearrangement, and disassembly of such structures.

Structures used to display advertising or goods at exhibitions and trade shows are generally set up for only a few hours or days, and are frequently disassembled, transported to a new site, and set up again. Often, only a short time period is available to set up or take down such structures, and it may become necessary to rearrange the structure during the exhibition, while minimizing disruption of the exhibitor's activities. In this environment, ease of assembly, rearrangement, and disassembly are at a premium, both to save time and labor costs and to enable inexperienced personnel to erect such structures.

To satisfy these requirements, it is highly desirable to provide a structural system using a minimum number of components having a maximum degree of interchangeability, which can serve a decorative or appearance function and still be structurally sound, yet are light in weight and easy to handle and transport. It is also important to simplify the assembly and disassembly process by eliminating the need for or significantly reducing the number of tools required to build a structure. In addition, since the size and dimensions at each exhibition site may vary, and because the exhibitor may wish to change the look of an exhibit at different sites, it is desirable to provide a structural system which allows a high degree of flexibility in arrangement.

The prior art discloses a number of systems for constructing temporary and permanent structures. Typical prior art systems employ a framework made up of vertical and horizontal members, which often surround wall-panels. Several means for attaching horizontal members to vertical members are disclosed in the prior art. For example, U.S. Pat. No. 4,346,540 to Anderson (FIG. 9 and col. 7, lines 11–18) discloses a horizontal beam having on a face thereof a central guide pin and two locking pins on opposite sides of the guide pin. A column has a hole adapted to receive the guide pin on the beam, and has two key-hole-shaped openings adapted to receive and lockingly engage the locking pins on the beam upon rotation of the column. However, none of the prior art discloses or suggests the uniquely simple and flexible structural system of the present invention, or the advantageous means for assembling and disassembling structures built according to said system.

SUMMARY OF THE INVENTION

The invention comprises a surprisingly simple structural system by which either temporary or permanent structures may be quickly and easily assembled, rearranged, and disassembled by simple procedures which require few or no tools, using a minimum number of components having a high degree of interchangeability. The invention is particularly useful for temporary exhibitions and trade shows.

In a particular embodiment a post is provided having a plurality of preformed holes arranged on a side with predetermined spacing; a panel is provided having an alignment pin and preformed hole on a face of the panel whose longitudinal axes are perpendicular to said face and arranged to correspond to holes in the post; and fastening means is provided which is adapted to pass through the hole in the panel and lock into a corresponding hole in the post to secure the panel to the post.

In another embodiment an angle bracket is provided having two faces disposed at a predetermined angle to each other comprising a panel mount and a post mount on said angle bracket, the panel mount having a plurality of holes arranged to correspond to the alignment pin and hole in the panel, and the post mount having an alignment pin and preformed hole arranged to correspond to holes in the post; and fastening means is provided which is adapted to pass through the hole in the panel and lock into a corresponding hole in the panel mount on the angle bracket, and adapted to pass through the hole in the post mount on the angle bracket and lock into a corresponding hole in the post.

There are other embodiments and aspects of the invention which are set forth more fully in the Detailed Description of the Preferred Embodiments.

DESCRIPTION OF THE PREFERRED EMBODIMENTS

Figure 1:
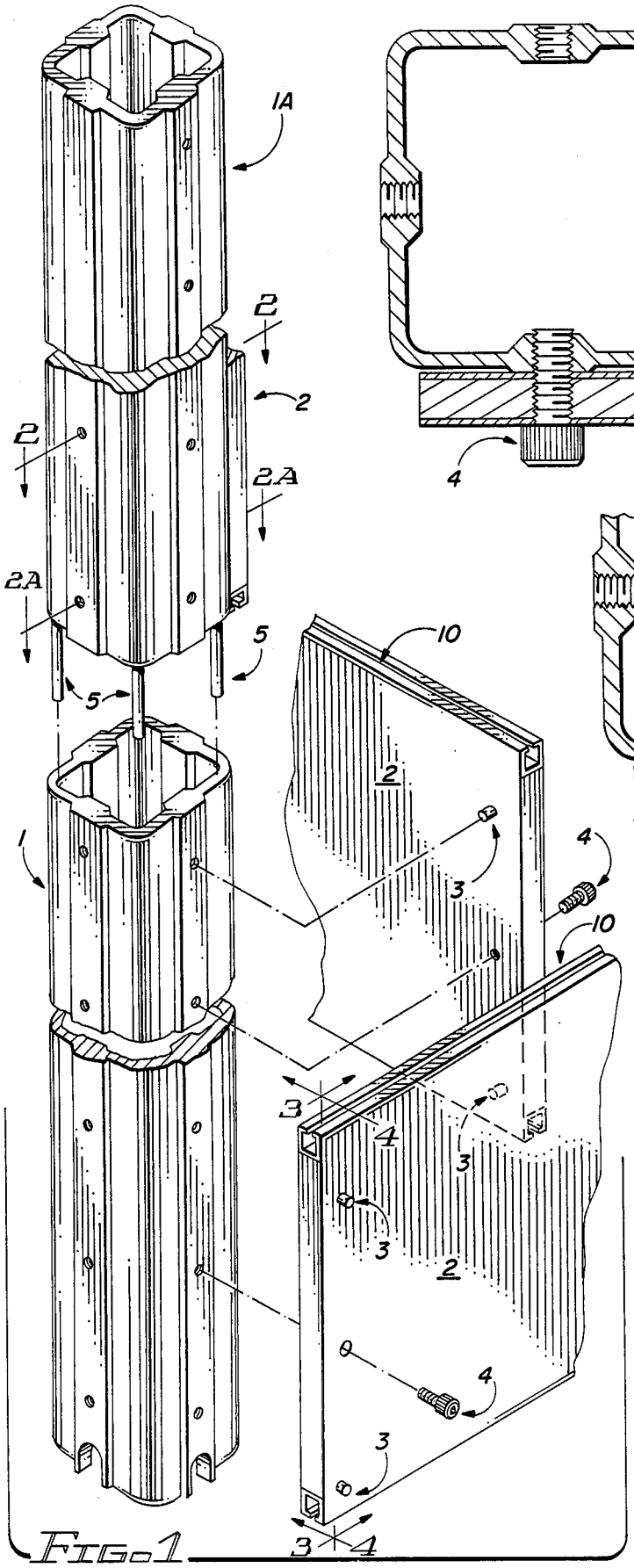
FIG. 1 is an exploded perspective view of a preferred embodiment of the invention showing how panels may be connected to a post.

The elegant simplicity and flexibility of the structural system can be appreciated by reference to the drawings. Referring first to FIG. 1, a post 1 is illustrated having a series of preformed holes arranged along its sides with predetermined spacing. Panels 2 have affixed to at least one face thereof alignment pins 3 and a preformed hole whose longitudinal axes are perpendicular to said face of each panel 2.

A panel 2 is attached to a post 1 by inserting alignment pins 3 on the panel 2 into corresponding holes on a side of the post 1, and by inserting a fastener 4 through the hole in the panel 2 into a corresponding hole in the post 1. The invention contemplates the use of a single alignment pin and a hole on the panel, although the preferred embodiment has two alignment pins 3 and a hole as shown. Where the panel has only one alignment pin, at least one side of the post should be provided with a plurality of holes which correspond to the alignment pin and hole on the panel. Where the preferred panel 2 having two alignment pins is used, at least one side of the post 1 should be provided with three holes to correspond to the two alignment pins 3 and the hole on the panel 2. Although the alignment pins provide resistance to shear forces in the post and panel connection, it is to be understood that the alignment pins do not lock within their corresponding holes in the post and function as a means for easing assembly and temporarily holding the panel in proper relationship or orientation to the post; the function of securing the panel to the post being reserved for the fastener 4.

In the preferred embodiment, the post 1 is an elongate hollow aluminum extrusion of generally square cross-section, and holes are arranged on the four sides of the post 1 lying on the longitudinal centerline of each side thereof, so that the longitudinal axes of holes on adjacent sides of the post 1 are perpendicular to each other. This arrangement will dispose panels at right angles to each other when attached to adjacent sides of the post 1, and makes the post 1 symmetrical on all sides about its longitudinal axis, simplifying the process of attaching panels 2 to the post 1 and adding to the interchangeability and flexibility of the system, because the geometry is the same no matter which side of the post 1 is presented in a given direction. The holes on each side of the preferred post 1 are spaced equidistant from one another, the advantage of which will appear from the following discussion.

Using a hollow aluminum extrusion for the post 1 provides a very strong but light-weight vertical support for the structural system, and provides an interior space in the post 1 through which electrical and electronic cables can be run. The cutouts provided at the bottom of the post 1 as illustrated in FIG. 1, make it easier to thread such cables into the interior of the post 1 as it sits on a floor. Notwithstanding, it will be understood that the post 1 need not be hollow, and can be made of a variety of materials, including without limitation, wood or plastic. Although the post 1 is preferably of square cross-section, it will also be understood that the post 1 can be of any geometric cross-section.

The alignment pins 3 and hole on the preferred panel 2 lie on the same line, and the alignment pins 3 are spaced equidistant from and on opposite sides of the hole on the panel 2, so that the hole on the panel 2 is intermediate of the two alignment pins 3. The spacing of the alignment pins 3 from the intermediate hole in the preferred panel 2 is equal to the equidistant spacing of holes in the sides of the preferred post 1. The advantage of using two alignment pins is that the panel 2 is more easily and quickly oriented to the post 1, the hole in the panel 2 is thereby lined up with the corresponding hole in the post 1 without having to pivot the panel 2 about an alignment pin 3, and since rotation of the panel 2 with respect to the post 1 is prevented, the panel 2 is more easily held in place while the fastener 4 is inserted to secure the panel 2 to the post 1. The equidistant spacing of the alignment pins 3 from the intermediate hole in the panel 2 lends further flexibility to the system, by enabling the attachment of the panel 2 to any three adjacent holes along a side of the preferred post 1.

Another advantage of using two alignment pins is that the panel and post connection is thereby strengthened. Those skilled in the art will understand that each alignment pin and fastener used in the panel and post connection contributes to the aggregate shear strength of this connection. Hence, using two alignment pins imparts greater shear strength than the use of a single alignment pin.

Although the fastener 4 shown in FIG. 1 is a threaded fastener, it will be understood that other types of fasteners such as clips or locking pins may be used to secure the panel 2 to the post 1. Where threaded fasteners 4 are used, all the holes in the post 1 should preferably be threaded, so that all said holes are potentially available for insertion of threaded fasteners 4, thereby maintaining the maximum number of attachment points for panels and other fixtures. Although the threaded fasteners 4 can be made of steel, in the preferred embodiment, the threaded fasteners 4 are made of plastic, to avoid galling or stripping the threads in the holes in the post 1.

Figure 2:
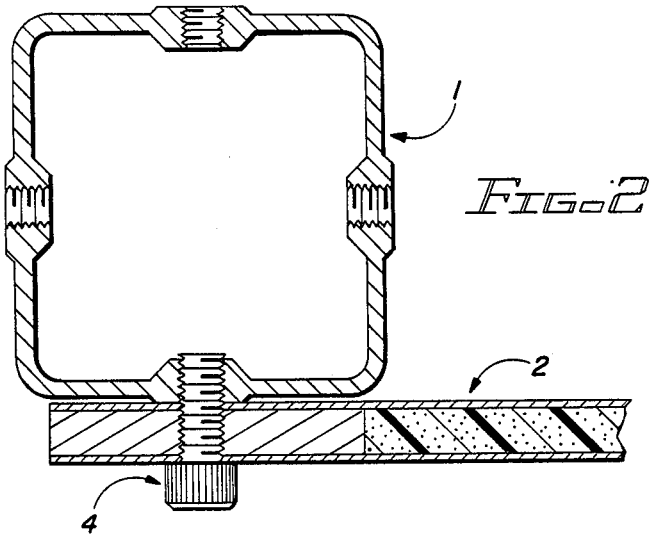
FIG. 2 is a sectional end view of a post and connected panel taken along section 2—2 in FIG. 1, showing how a threaded fastener secures the panel to the post.

FIG. 2 further illustrates how a threaded fastener 4 may be inserted through the hole in a panel 2 and into locking engagement with a corresponding threaded hole in the post 1, to secure the panel 2 to the post 1. The illustrated threaded fastener 4 is a hex socket screw or bolt preferably made of plastic, having a knurled head to facilitate hang-tightening thereof. For many applications such hand-tightening is all that is necessary, and in such cases, no tools are needed to assemble or disassemble structures built according to the invention. Where a more secure connection is desired, a simple allen wrench of the proper size may be used to quickly tighten or loosen the threaded fastener 4.

Figure 2A:
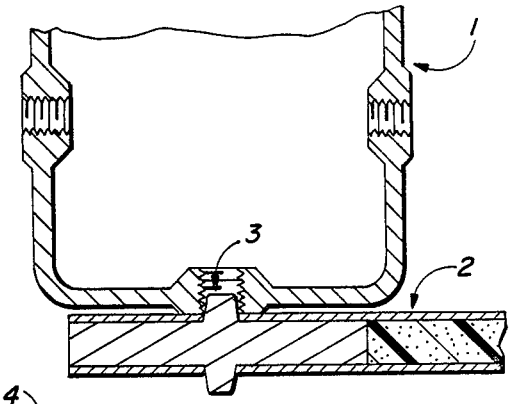
FIG. 2A is a sectional end view of a post and connected panel taken along section 2A—2A in FIG. 1, showing how the alignment pin on a panel fits in a corresponding hole in the post.

FIG. 2A shows an alignment pin 3 on a panel 2 inserted into a corresponding hole in the post 1. In its preferred form, the alignment pin 3 is tapered slightly to facilitate its insertion into the holes in the post 1. In addition, the taper of the alignment pin 3 prevents damage to the threads in the holes on the preferred post 1 when the alignment pin 3 is inserted therein. Thus it is seen that the alignment pins serve an alignment function and provide resistance to shear forces in the panel and post connection, but do not lock within corresponding holes in the post nor themselves serve to secure the panel 2 to the post 1.

Figure 2B:
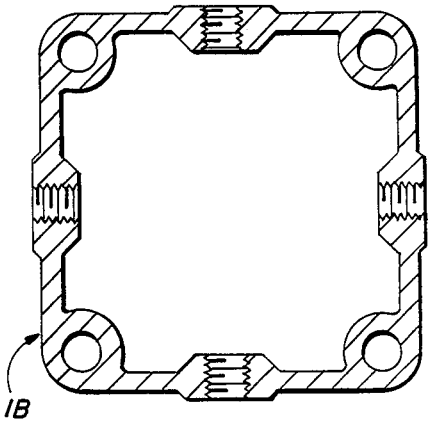
FIG. 2B is a cross-sectional end view of a post of alternative cross-section.

Referring again to FIG. 1, a post extender 1A is shown having extension rods 5 secured to the inside of the hollow post extender 1A parallel to its longitudinal axis and protruding from the bottom of the post extender 1A. The protruding portions of the extension rods 5 are inserted into the top of the hollow post 1 and by frictional engagement hold the post extender 1A to the post 1. The post extender 1A preferably has the same cross-sectional shape as the post 1. FIG. 2B depicts a post 1B of alternative cross-section, which is designed to more readily receive and secure the extension rods 5 of the post extender 1A. Other methods of securing a post extender to the post 1 will readily suggest themselves in light of the instant disclosure.

Figure 3:
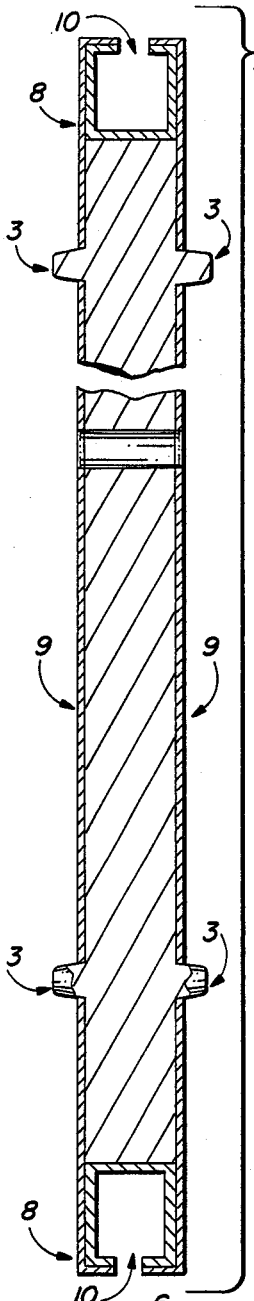
FIG. 3 is a sectional end view of a panel taken along section 3—3 in FIG. 1.

FIG. 3 is a sectional end view of a panel 2, showing the arrangement of the alignment pins 3 and the intermediate hole in the panel 2. It can be seen that the preferred panel 2 has a pair of alignment pins 3 symmetrically arranged on both its faces, so that each face carries a pair of alignment pins. This feature lends simplicity and flexibility to the system by eliminating the possibility of having to flip the panel 2 to present a pair of alignment pins 3 to the corresponding holes in the post 1. Also, once the panel 2 is secured to the post 1 in the above-described manner, a pair of alignment pins 3 on the panel 2 are thereby left exposed (see FIG. 1) to facilitate the attachment of other brackets, fixtures, and the like as set forth below.

Figure 5:
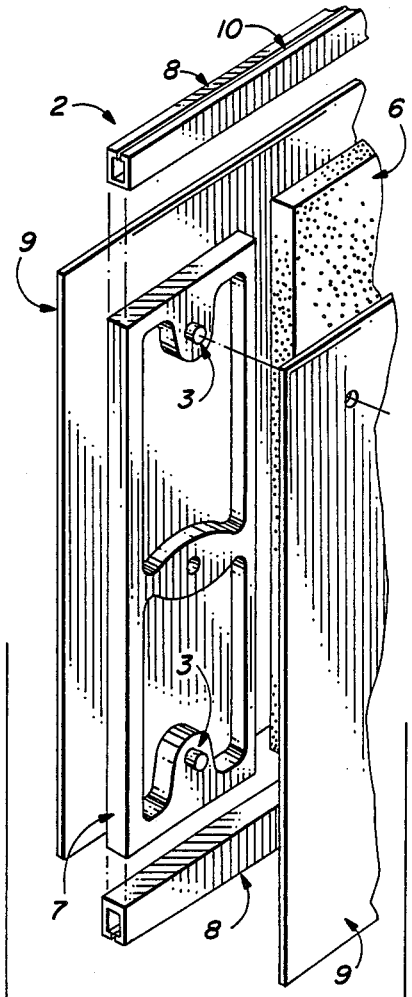
FIG. 5 is an exploded perspective view of a preferred panel.
Figure 4:
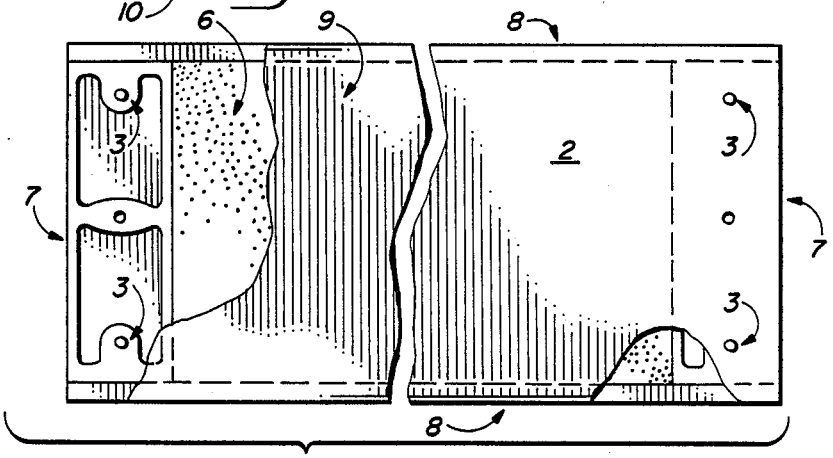
FIG. 4 is a broken sectional front view of a preferred panel taken along section 4—4 in FIG. 1.

FIGS. 4 and 5 illustrate the construction of a preferred panel 2. As shown in FIG. 4, the preferred panel 2 has a pair of alignment pins and an intermediate hole therein at both its ends, to allow the attachment of a panel 2 between two posts as hereafter described. Although not required by the invention, the preferred panel 2 is elongate, its length being greater than its height.

Although the panel may be made of a unitary material such as wood or plastic, the illustrated panel 2 is a composite structure which is lightweight yet structurally strong. A panel core 6 is comprised of a known rigid foam material, and is encompassed at its ends by pin structures 7 and along its longitudinal edges by frame members 8. The pin structures 7 are preferably aluminum castings or extrusions, and carry the alignment pins 3 used in connecting the panel 2 to a post. The frame members 8 are preferably aluminum extrusions, and may be fastened to the ends of the pin structures 7 by any of a number of conventional fastening means, including the use of screws or adhesives, to form a framework around the panel core 6. It will be understood that the pin structures and frame members could be made of plastic or a variety of other materials. The panel core 6 is preferably secured within the framework formed by pin structures 7 and frame members 8 by adhesive means, or the framework can be filled with a plastic resin which cures into a rigid foam to form the panel core 6.

Both faces of the panel 2 so constructed are preferably covered by panel covers 9. Panel covers 9 are primarily decorative in purpose, and may be comprised of a multitude of materials, including without limitation, cloth, plastic, or sheet metal. However, where the panel covers 9 are composed of a stiff material such as rigid plastic or sheet metal, the panel covers 9 add to the structural integrity of the panel 2, and help protect the panel core 6 against punctures or breakage. The panel covers 9 may be secured to the underlying panel structure by a variety of conventional means, including the use of screws, staples, or adhesives.

As depicted in FIGS. 1, 3, and 5, the preferred panel 2 is provided with a channel or groove 10 along its longitudinal edges in which various types of fixture brackets, such as clips, hooks, hangers or clamps may be affixed. The preferred means for providing these channels or grooves is to use grooved frame members 8 which make up the longitudinal edges of the panel 2. It will be understood that there are other means of providing a channel or groove in the longitudinal edges of the panel. To maintain symmetry and a simple, flexible system that does not require flipping of the panel to properly orient the groove 10 in the panel, as well as to provide a maximum of fixture attachment surfaces, the preferred panel 2 has a groove along both its longitudinal edges.

Figure 7:
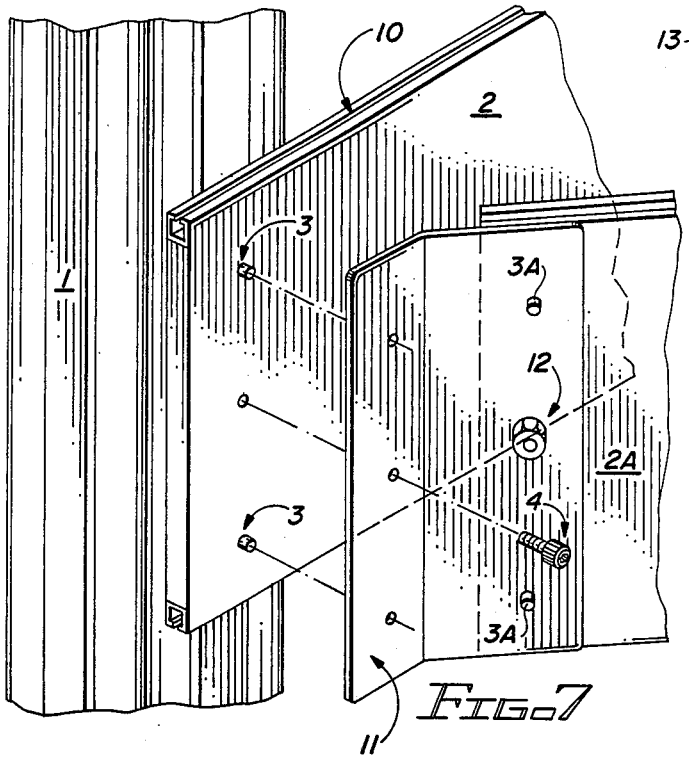
FIG. 7 is an exploded perspective view showing how a panel may be connected at a predetermined angle to a post using an angle bracket.
Figure 8:
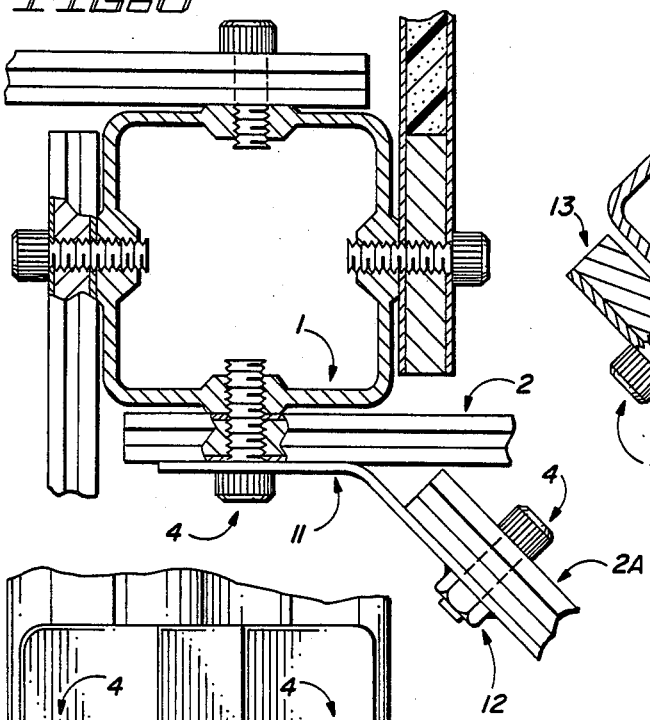
FIG. 8 is a cross-sectional end view of a post showing how panels may be connected directly thereto, or at predetermined angles to the post using angle brackets.
Figure 9:
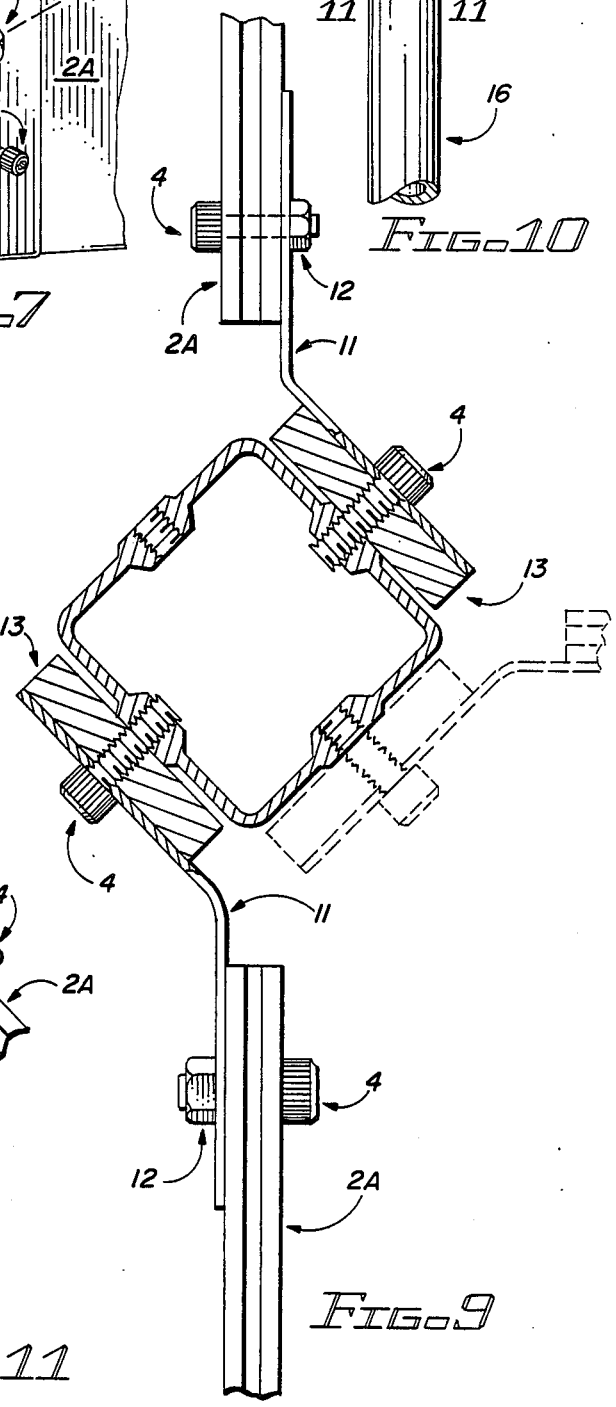
FIG. 9 is a cross-sectional end view of a post showing how panels may be connected at predetermined angles to the post using angle brackets and spacers.

Turning now to FIGS. 7, 8, and 9, it is shown how a panel 2A may be secured to a post 1 using an angle bracket 11, to dispose the panel 2A at a predetermined angle to the post 1. The angle bracket 11 has two faces disposed at a predetermined angle to each other.

Referring to FIGS. 7 and 8, a panel 2A may be attached to the post 1 by means of an angle bracket 11 over an intervening panel 2. In the preferred embodiment shown, one face of the angle bracket 11 comprises a panel mount which has three preformed holes arranged along a line, two of these holes being spaced equidistant from an intermediate hole to which a threaded nut 12 has been welded. The alignment pins 3A on the panel 2A are inserted into corresponding holes in the panel mount on the angle bracket 11 (see FIG. 7), and a threaded fastener 4 is inserted through the hole in the panel 2A from the opposite side of the panel 2A, through the intermediate hole in the panel mount on the angle bracket 11, and engaged with the threaded nut 12 on the angle bracket 11 to secure the angle bracket 11 to the panel 2A (see FIG. 8). Other means of securing the angle bracket to the panel 2A will suggest themselves to those skilled in the art.

As shown in FIG. 7, the other face of the angle bracket 11 comprises a post mount which has three preformed holes arranged along a line, two of said holes being spaced equidistant from an intermediate hole therein. The panel 2 shown already in place on the post 1, has one pair of alignment pins 3 inserted into corresponding holes in the post 1, and another exposed pair of alignment pins 3 directed outwardly from the post 1. Corresponding holes in the panel mount on the angle bracket 11 are inserted over the exposed pair of alignment pins 3 on the panel 2, and a fastener 4 is inserted through the intermediate hole on the panel mount on the angle bracket 11, through the intermediate hole in the panel 2, and into locking engagement in a corresponding hole in the post 1, to secure the angle bracket 11 (and the attached panel 2A) and the panel 2 to the post 1.

FIG. 9 illustrates how a panel 2A may be attached to the post 1 by means of an angle bracket 11, where there is no intervening panel 2. The panel mount on the angle bracket 11 and the panel 2A are secured together in the manner described above, and the post mount on the angle bracket 11 is attached to the post 1 in the manner outlined above over an intervening spacer 13.

Figure 6:
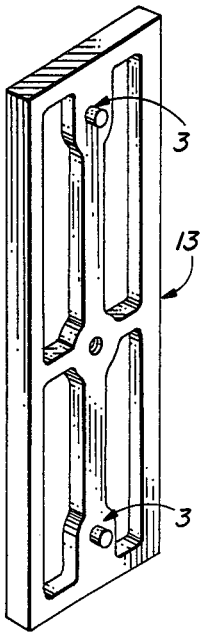
FIG. 6 is a perspective view of a spacer which may be used in conjunction with angle brackets as illustrated in FIG. 9 supra.

As shown in FIG. 6, the spacer 13 has a pair of alignment pins 3 on a side thereof (preferably pairs of alignment pins 3 symmetrically arranged on both sides of the spacer 13) lying in line with and spaced equidistant from an intermediate hole whose longitudinal axes are perpendicular to said side of the spacer 13. The spacer 13 is thus functionally equivalent to the pin structure 7 shown in FIGS. 4 and 5, and is approximately the same thickness as the panel 2. To attach the post mount on the angle bracket 11 to the post 1 as shown in FIG. 9, the alignment pins on one side of a spacer 13 are inserted into corresponding holes in the post 1, leaving an exposed pair of alignment pins on the spacer 13 directed outwardly from the post 1. Corresponding holes in the post mount on the angle bracket 11 are inserted over the exposed alignment pins on the spacer 13, and a fastener 4 is inserted through the intermediate hole in the post mount on the angle bracket 11, through the intermediate hole in the spacer 13, and into locking engagement in a corresponding hole in the post 1, to secure the angle bracket 11 (and the attached panel 2A) and the spacer 13 to the post 1.

When an angle bracket is to be installed to the post 1 in the absence of an intervening panel 2, the spacer 13 is not an essential feature. Rather, the post mount on the angle bracket, instead of having three holes, could be provided with a pair of alignment pins for insertion in corresponding holes in the post, and could be provided with an intermediate hole to allow the insertion of a fastener through the angle bracket 11 and into locking engagement with a corresponding hole in the post 1 (not illustrated). However, when the described components are used to construct structural modules or larger structures as described below, and angle brackets are used to secure panels 2A to posts in such structures, panels 2A designed to be attached to posts over an intervening panel 2 must be shorter than panels 2A designed to be attached to posts in the absence of an intervening panel 2. To simplify the system and enable panels 2A of the same length to be used in either situation, spacers 13 having approximately the same thickness as a panel 2 are preferably used where panels 2A are to be attached to posts in the absence of a intervening panel 2. Functionally, the combination of the angle bracket 11 and the spacer 13 act as an angle bracket having alignment pins for direct insertion into corresponding holes in the post 1. Indeed, the spacer 13 could be permanently fixed to the angle bracket 11 to form an angle bracket having alignment pins.

Figure 12:
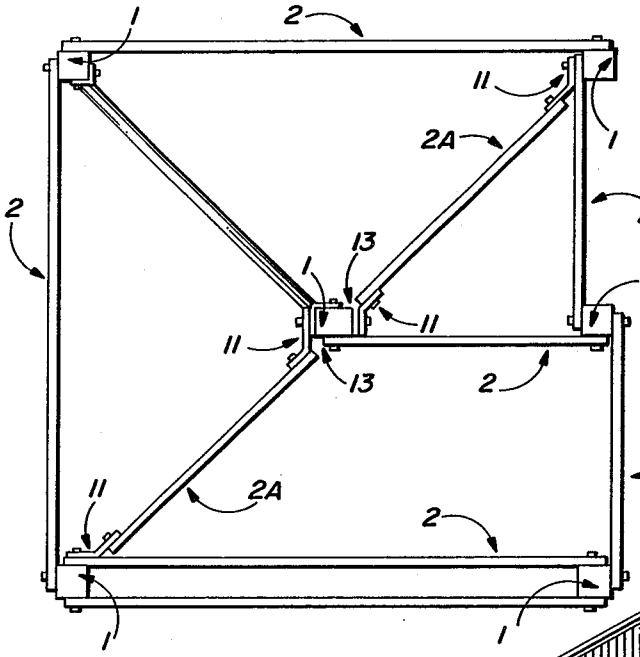
FIG. 12 is a plan view of a representative structural module illustrating the flexibility with which panels may be attached to posts to form structures.

FIG. 12 depicts a representative structural module 14 seen in plan view constructed with posts, panels, and angle brackets as previously described. As will be seen, such structural modules serve as the "building blocks" for the construction of larger structures. The preferred structural module shown has a square plan-shape having both perpendicular and diagonal interior cross-members. It is apparent that L-plan shaped and triangle plan-shaped modules can also be constructed in the illustrated manner using components designed for a square module.

The preferred plan-geometry for the structural module 14 is a square shape because the panels 2 can be made to a uniform length, the panels 2A can be of a second uniform length, and the angle brackets 11 will all have the same bend angle. This promotes the aim of maximum interchangeability of the components of the system, lending simplicity and flexibility thereto. Once the dimensions for the system components have been established, these components can be used to construct square structural modules (with or without cross-members), triangle plan-shaped structural modules, L-plan shaped modules, etc.

Although the preferred plan-geometry for the structural module 14 is square due to its inherent simplicity, it will be readily understood that the plan-geometry may be of any shape by varying the dimensions of the described system components; including rectangular, triangular, or any other polygonal or geometric shape, limited only by practical considerations such as the number of sides to a structural module that can be effectively handled given the over-all dimensions of the desired module, the extent to which attachment surfaces are available on the posts, and the practicality of using angle brackets to handle certain panel and post connections.

The preferred panels 2 and 2A have a pair of alignment pins and an intermediate hole adjacent both ends thereof, to facilitate the attachment of said panels between two spaced-apart posts 1. The preferred posts 1 are of square cross-section and provided with a sufficient number of holes on each side to correspond to the alignment pins and holes at the ends of the panels 2, lying on the longitudinal centerline of each side of the posts. These holes are arranged so that the longitudinal axes of the holes on adjacent sides of the post 1 are perpendicular to each other. This arrangement will dispose panels at right angles to each other when attached to adjacent sides of a post 1, to create the desired L-plan shaped or square modules. It will be understood that the longitudinal axes of the holes on adjacent sides of the posts can be disposed at any predetermined angle to each other, to create modules of any desired plan-shape. It will also be understood that angle brackets whose faces are bent to predetermined angles with each other may be used to attach panels to posts of any cross-section (including the preferred square posts 1) to create modules of varying plan-shapes.

The longitudinal axis of a post 1 is placed at each of the corners or vertices of the structural module 14 and at other desired points in the module. As shown, the posts 1 stand vertically and are generally perpendicular to the floor. Panels 2 and 2A are horizontally oriented along their respective longitudinal axes and attached between desired pairs of posts 1 using the alignment pin and connection means described in detail above.

Here, a particular advantage of using two alignment pins at the ends of the panels can be observed. Where each end of a panel has only a single alignment pin, until a fastener is inserted through the hole in each end of a panel into a corresponding hole in a post, the structure formed by the placement of a panel between two spaced-apart posts has poor diagonal stability since the alignment pins can rotate in their respective holes in their corresponding posts. This makes assembly cumbersome, because the structure must be held steady until the fasteners are inserted and locked in place to prevent the structure from collapsing. Using two alignment pins at the ends of the panels prevents rotation of the alignment pins in their respective holes in their corresponding posts, thereby providing diagonal stability independent of the fasteners used to secure panels to posts. This not only makes the assembly of structures easier, but provides greater shear resistance to forces tending to upset the diagonal stability of an assembled structure and cause its collapse.

Panels 2 may be attached in the above manner to sides of the posts 1 which face either inside or outside the module. As seen on the right side of the module in FIG. 12, where a side of a module or structure is broken up into two or more contiguous sections with intervening posts 1, and where contiguous panels 2 are to be attached at the same height on the involved posts, the contiguous panels 2 in the preferred embodiment are attached to alternate sides of the involved posts 1 (see also FIG. 13).

FIG. 12 also illustrates how panels 2A may be incorporated in the preferred structural module 14 using angle brackets 11 to form diagonal cross-members within the module, or to form triangle plan-shaped modules. As shown, panels 2A each having an angle bracket 11 secured to its ends, are attached in the manner previously described between the desired posts 1- either over a intervening panel 2, or over an intervening spacer 13.

Once the dimensions of the basic structural module are established, it becomes a matter of calculation to determine the placement of the alignment pins and holes on the panels 2 and 2A and the thickness and other dimensions of the panels 2 and 2A, as well as the bend angle and hole (or alignment pin) locations for the angle brackets 11, and the thickness and alignment pin and hole locations of the spacers 13 needed to impart the desired geometry.

Figure 13:
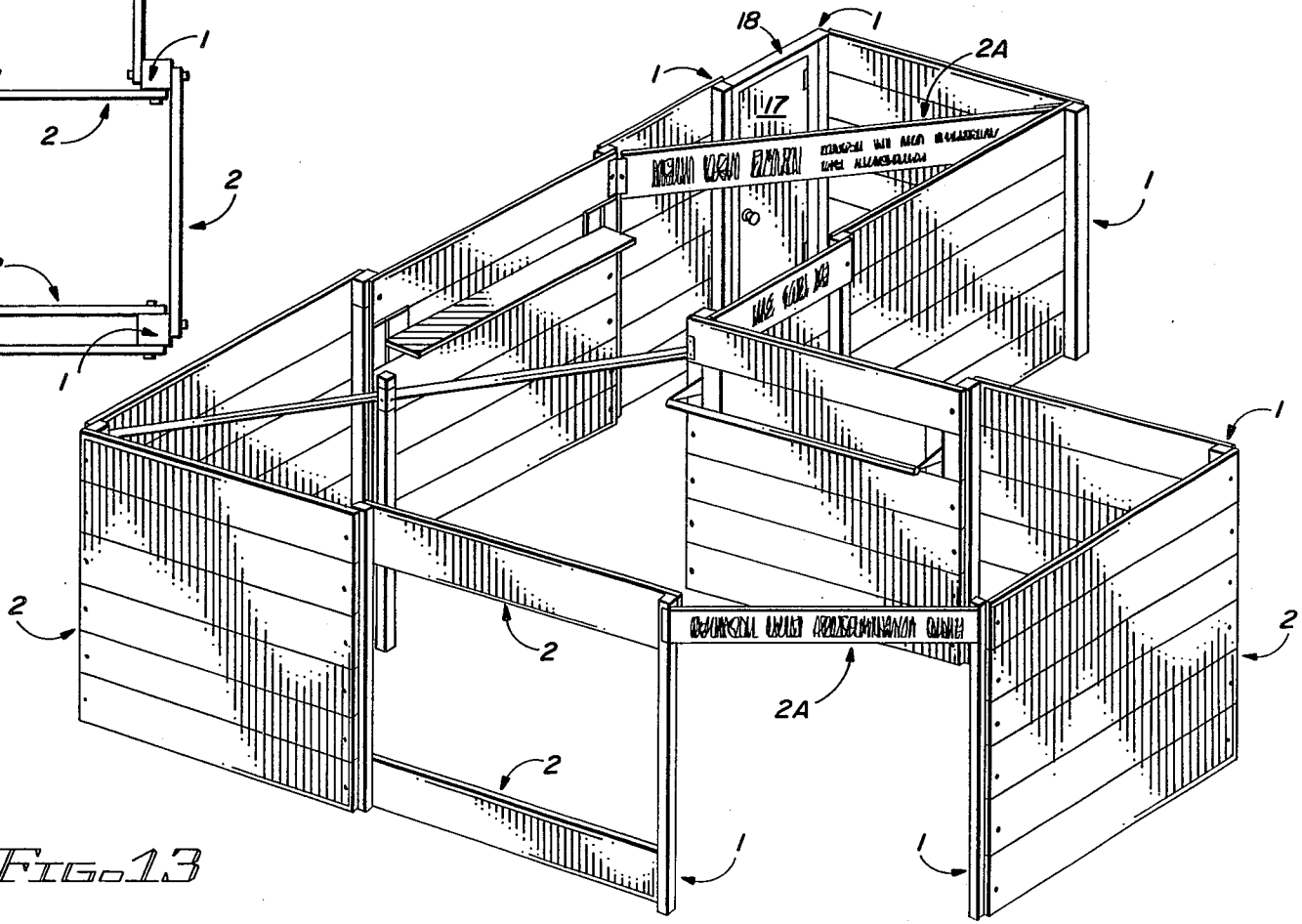
FIG. 13 is a perspective view of a representative structure which can be assembled from posts and panels.

FIG. 13 depicts a representative structure which can be assembled from the described system components. A plan layout for such a structure is made by blocking out a series of connected modules of predetermined size and shape in any desired pattern. To set up the structure according to the planned layout, the longitudinal axis of a post 1 is placed at each of the desired corners or vertices of the modules in the layout so that the posts stand vertically on the floor, and panels 2 or 2A are secured between desired posts 1 in the manner set forth herein.

FIG. 13 clearly illustrates the advantageous simplicity and flexiblity achieved by the invention. It can be seen that using a relatively small number of different components, structures including simple "fence" sections (two posts with a single panel connected between them), full or partial walls, "window" sections, entire rooms, and even complete malls can be easily constructed in a minimum amount of time, and with a minimum of labor. It is also seen that the look which may be given to such structures is uniquely variable, and easily changed.

The panels 2 and 2A serve multiple functions. Not only do the panels 2 and 2A serve as primary structural members in structural modules and larger structures made therefrom, but the panels also serve a decorative or appearance function, and provide physical and visual barriers as desired. As shown in FIG. 13, multiple panels can be successively mounted or attached one above or next to another between desired pairs of posts to create walls, or spaced apart on particular pairs of posts to leave open "window" spaces. Where the preferred panels are used, each having grooves along its longitudinal edges, sheets of glass or plastic can be inserted into the grooves between adjacent panels attached to the same pair of posts, to fill in these "window" spaces. The described approach is different from and significantly more flexible than typical prior art exhibit systems which use full wall-panel sections.

In the preferred embodiment of the invention, the height of the panels and the relative spacing of the holes on the posts are such that when multiple panels are successively mounted one above or next to another between the same pair of posts and on the same sides of said posts to create a wall section, a small gap is left between adjacent panels sufficient to access the grooves along the longitudinal edges of the panels. This enables the insertion therein of various fixture brackets, such as clips, hooks, hangers or clamps adapted to engage the grooves in said panels, without having to first remove any of said panels from an assembled structure. By means of such panel fixture brackets, numerous types of fixtures can be easily hung from or attached within the grooves in the panels. For example, a light bar having panel fixture brackets at each end, might be attached at its ends within the grooves of panels mounted on different sides of a structure. Other examples of such fixtures might include without limitation, lighting fixtures, shelves, hanger bars, merchandise display racks, sign panels and so on. Some of these are illustrated in FIG. 13.

Figure 10:
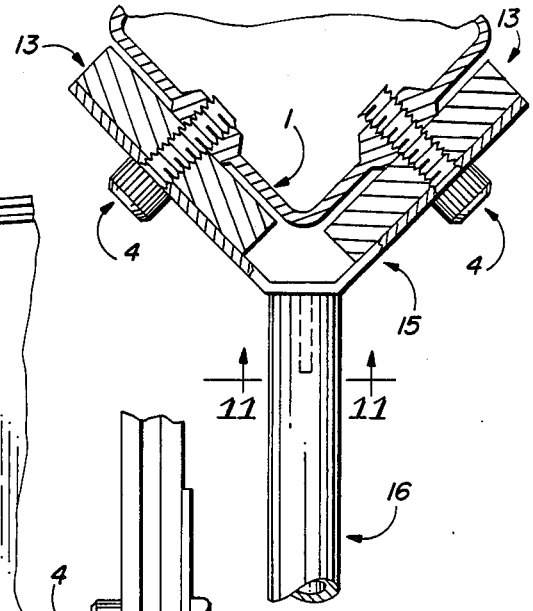
FIG. 10 is a cross-sectional end view of a post showing how a typical fixture bracket may be attached to the post.
Figure 11:
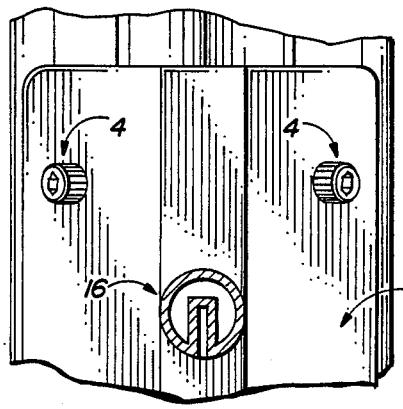
FIG. 11 is a sectional view of a typical fixture bracket taken along section 11-11 in FIG. 10, showing how the fixture bracket may be attached to the post.

In addition, fixture brackets may be provided which can be attached to posts. For example, FIGS. 10 and 11 illustrate a post fixture bracket 15 with an attached hanger bar 16 which may be attached to a post using threaded fasteners 4 over intervening spacers 13. Although FIG. 10 shows the post fixture bracket 15 installed over spacers 13, it will be understood that a post fixture bracket having alignment pins could be attached direct to the post 1 without intervening spacers. It is thus seen that the present invention provides great flexibility in the types of fixtures which can be easily attached to structures constructed according to the invention, and provides a large number of attachment points or surfaces for fixtures in such structures.

FIG. 13 also shows that a door may be attached to a structure made according to the invention. The door 17 is surrounded by a door-frame 18 having two vertical door-frame members and a horizontal door-frame member across the top. The door 17 is hingedly attached to one of the vertical door-frame members, and the other vertical door-frame member carries a portion of a conventional latch mechanism for holding the door in closed position. The vertical door-frame members are preferably of U-shaped cross-section of sufficient width to admit the hand of an assembly person.

The outside lateral edges of the vertical door-frame members are provided with holes spaced to match the holes on posts used in the structure, and the door-frame 18 is of a width to fit the predetermined spacing of posts in a structure. To install the door-frame 18 and attached door 17 to a structure, the door-frame 18 is inserted in the space left between the two desired posts, and fasteners are inserted through the holes in the lateral edges of the vertical door-frame members into locking engagement with corresponding holes in said posts, securing the door-frame 18 and the attached door 17 to the structure. Alternatively, the vertical door-frame members could have the same construction as posts used in the system, and panels could be attached thereto in the manner disclosed herein.

Although such are not illustrated, in addition to the above-described components, those skilled in the art will be able in view of this disclosure to device a variety of means for attaching ceiling, roof, or canopy members to structures made according to the invention, utilizing the grooves in the longitudinal edges of the panels, the top openings of the preferred hollow posts, the holes provided in the posts, or the holes and alignment pins provided in the panels.

From the foregoing disclosure it will be appreciated by those skilled in the art that equivalent alternatives to the preferred embodiments can be perceived, all of which are embraced by the claims herein.

What is claimd is:

1. A structural system comprising:

a. A post having a plurality of preformed holes arranged on a side with predetermined spacing;

b. A panel having an alignment pin extending perpendicular from a face and integral therewith and a separate preformed hole on said face of said panel whose longitudinal axis is perpendicular to said face and said alignment pin and said preformed holes are arranged to correspond to holes in said post; and c. Fastening means adapted to pass through the hole in the panel and lock into a corresponding hole in the post to secure said panel to said post.

2. A structural system according to claim 1 wherein said post has at least three preformed holes arranged on a side with predetermined spacing and said panel has two alignment pins arranged on a face of said panel so that the alignment pins and hole on the panel correspond to holes in said post.

3. A structural system according to claim 2, wherein said panel has pairs of alignment pins symmetrically arranged on both faces of said panel.

4. A structural system comprising:

a. A post having a plurality of preformed holes arranged on a side with predetermined spacing;

b. A panel having an alignment pin extending perpendicular form the race and integral therewith and a separate preformed hole on said face of said panel whose longitudinal axis is perpendicular to said face;

c. An angle bracket having two faces disposed at a predetermined angle to each other comprising a panel mount and a post mount on said angle bracket, the panel mount having a plurality of holes arranged to correspond to the alignment pin and hole in said panel, and the post mount having an alignment pin and a separate preformed hole arranged to correspond to holes in said post; and d. Fastening means adapted to pass through the hole in said panel and lock into a corresponding hole in the panel mount on said angle bracket, and adapted to pass through the hole in the post mount on the angle bracket and lock into a corresponding hole in the post.

5. A structural system comprising:

a. A post having a plurality of preformed holes arranged on a side with predetermined spacing;

b. A panel having an alignment pin and a separate preformed hole on a face of said panel whose longitudinal axes are perpendicular to said face;

c. A spacer of predetermined thickness having an alignment pin on both a first and second side thereof and having a separate preformed howl through said spacer whose longitudinal axes are perpendicular to the sides of said spacer, the alignment pin on the first side of said spacer and the hole in said spacer being arranged to correspond to holes in said post;

d. An angle bracket having two faces disposed at a predetermined angle to each other comprising a panel mount and a post mount on said angle bracket, the panel mount having a plurality of holes arranged to correspond to the alignment pin and hole in said panel, and the post mount having a plurality of preformed holes arranged to correspond to the alignment pin on the second side of said spacer and the hole in said spacer; and e. Fastening means adapted to pass through the hole in said panel and lock into a corresponding hole in the panel mount on said angle bracket, and adapted to pass through the hole in the post mount on the angle bracket which corresponds to the hole in said spacer and to pass through the hole in said spacer and lock into a corresponding hole in the post.

6. A structural system according to claim 1, wherein said panel is elongate and has a groove provided in at least one longitudinal edge for the attachment of fixture brackets.

7. A structural system according to claim 1, wherein a plurality of said panels are provided and said post has a sufficient number of holes on a side or sides to correspond to the alignment pins and holes on said panels.

8. A structural system according to claim 7, wherein the holes in said post are arranged such that a gap is left between panels mounted successively on a side of said post and at least one said panel has a groove provided in an edge adjacent said gap for the attachment of fixture brackets.

9. A structural system according to claim 1, wherein said post is an elongate hollow aluminum extrusion.

10. A structural system according to claim 1, wherein said panel further comprises a sheet of rigid foam of predetermined dimensions, the edges thereof being surrounded by a framework.

11. A structural system according to claim 1, wherein the holes in said post are threaded and said fastening means is a threaded fastener.

12. A structural system according to claim 1, further comprising:

a. A fixture bracket having an alignment pin and a separate preformed hole arranged to correspond to holes in said post; and b. Fastening means adapted to pass through the hole in the fixture bracket and lock into a corresponding hole in said post to secure said fixture bracket to said post.

13. A structural system comprising:

a. Two posts each having a plurality of preformed holes arranged on a side with predetermined spacing;

b. A panel having two ends and having an alignment pin extending perpendicular from a face and integral therewith and said separate preformed hole on a face of said panel adjacent each end of said panel whose longitudinal axis is perpendicular to said face and said alignment pin and said preformed holes are arranged to correspond to holes in each corresponding post; and c. Fastening means adapted to pass through the holes adjacent each end of the panel and lock into corresponding holes in said corresponding posts to secure said panel to said posts.

14. A structural system comprising:

a. Two posts each having a plurality of preformed holes arranged on a side with predetermined spacing;

b. A panel having two ends and having an alignment pin extending perpendicular from a face and integral therewith and a separate preformed hole on said face of said panel adjacent each end of said panel whose longitudinal axis is perpendicular to said face;

c. First and second angle brackets each having two faces disposed at predetermined angles to each other comprising a panel mount and a post mount on said angle brackets, the panel mounts each having a plurality of holes arranged to correspond to the alignment pin and hole adjacent an end of said panel and the post mounts each having an alignment pin and a separate preformed hole arranged to correspond to holes in corresponding posts; and d. Fastening means adapted to pass through the holes adjacent the ends of said panel and lock into corresponding holes in the panel mounts on said first and second angle brackets, and to pass through the holes in the post mounts on said first and second angle brackets and lock into corresponding holes in corresponding posts, to secure said panel to said angle brackets and to secure said angle brackets to said posts.

15. A structural system according to claim 13, wherein a plurality of said panels are provided and said posts each have a sufficient number of holes on a side or sides to correspond to the alignment pins and holes on said panels.

16. A structural system according to claim 15, wherein the holes in said posts are arranged such that a gap is left between panels mounted successively on a side of each said post and at least one said panel has a groove provided in an edge adjacent said gap for the attachment of fixture brackets.

17. A system for constructing structural modules of varying geometric-plan shapes comprising:

a. At least three vertical posts each having a plurality of preformed holes arranged on a side or sides with predetermined spacing;

b. A plurality of panels each of a predetermined length and each having two ends and having an alignment pin extending perpendicular from a face and integral therewith and a separate preformed hole on said face of each said panel whose longitudinal axis is perpendicular to said face positioned adjacent the ends of each said panel and said alignment pin and said preformed holes are arranged to correspond to holes in each corresponding post; and c. Fastening means adapted to pass through the holes at the ends of each said panel and lock into corresponding holes in each corresponding post to secure said panels to said posts.

18. A system for constructing structural modules according to claim 17, wherein at least one said post has a plurality of preformed holes arranged on at least two adjacent sides so that the longitudinal axes of said holes on said adjacent sides are disposed at a predetermined angle to each other.

19. A system for constructing structural modules according to claim 17, wherein at least one said post has a plurality of preformed holes arranged on at least two adjacent sides so that the longitudinal axes of said holes on said adjacent sides are perpendicular to each other.

20. A system for constructing structural modules of varying geometric-plan shapes comprising:

a. At least three vertical posts each having a plurality of preformed holes arranged on a side or sides with predetermined spacing;

b. A plurality of panels each of a predetermined length and each having two ends and having an alignment pin extending perpendicular from a face and integral therewith and a separate preformed hole on said face of each said panel whose longitudinal axis is perpendicular to said face and positioned adjacent the ends of each said panel;

c. A plurality of angle brackets each having two faces disposed at predetermined angles to each other comprising a panel mount and a post mount on said angle brackets, the panel mounts each having a plurality of holes arranged to correspond to the alignment pin and hole adjacent each end of said panels and the post mounts each having an alignment pin and a separate preformed hole arranged to correspond to holes in corresponding posts; and d. Fastening means adapted to pass through the holes adjacent the ends of said panels and lock into corresponding holes in the panel mounts on said angle brackets, and to pass through the holes in the post mounts on said angle brackets and lock into corresponding holes in corresponding posts, to secure said panels to said angle brackets and to secure said angle brackets to said posts.

* * * * *